US012091279B2

(12) United States Patent
Buchmuller et al.

(10) Patent No.: US 12,091,279 B2
(45) Date of Patent: Sep. 17, 2024

(54) SUCTION DEVICE FOR A TEXTILE MACHINE, TEXTILE MACHINE WITH A SUCTION DEVICE, USE OF TWO CYCLONE ELEMENTS, AND METHOD FOR SUCTIONING YARNS

(71) Applicant: Heberlein AG, Wattwil (CH)

(72) Inventors: Patrick Buchmuller, Krummenau (CH); Andreas Brunner, Wuppenau (CH)

(73) Assignee: Heberlein Technology AG, Wattwil (CH)

( * ) Notice: Subject to any disclaimer, the term of this patent is extended or adjusted under 35 U.S.C. 154(b) by 225 days.

(21) Appl. No.: 17/619,862

(22) PCT Filed: Apr. 24, 2020

(86) PCT No.: PCT/EP2020/061419
§ 371 (c)(1),
(2) Date: Dec. 16, 2021

(87) PCT Pub. No.: WO2020/254015
PCT Pub. Date: Dec. 24, 2020

(65) Prior Publication Data

US 2022/0356038 A1 Nov. 10, 2022

(30) Foreign Application Priority Data

Jun. 19, 2019 (EP) ..... 19181256

(51) Int. Cl.
*B65H 54/88* (2006.01)

(52) U.S. Cl.
CPC ..... *B65H 54/88* (2013.01); *B65H 2406/35* (2013.01); *B65H 2701/31* (2013.01)

(58) Field of Classification Search
CPC ..... B65H 54/88
(Continued)

(56) References Cited

U.S. PATENT DOCUMENTS 3,226,165 A * 12/1965 Karl-Heinz ..... G21C 1/22 406/114
3,664,354 A * 5/1972 Minbiole, Jr. ..... B65G 49/0495 118/62

(Continued)

FOREIGN PATENT DOCUMENTS

CN 105668327 A 6/2016
DE 3206478 A1 2/1983

(Continued)

OTHER PUBLICATIONS

European Search Report of the European Patent Office for European Patent No. 19181256.9 dated Nov. 28, 2019, 9 pages. English translation not available.

(Continued)

*Primary Examiner* — Joseph A Dillon, Jr.
(74) *Attorney, Agent, or Firm* — Finch & Maloney PLLC

(57) ABSTRACT

A suction device (100) for a textile machine comprising a mouthpiece (2) for introducing at least one yarn, a suction pipe (3) for guiding the yarn and a suction element (5) for generating a suction pressure. The suction element (5) comprises at least two cyclone elements (1*a*, 1*b*) for generating a vortex flow of compressed air. The cyclone elements (1*a*, 1*b*) are arranged one behind the other in the suction direction (A), so that a yarn can be passed first through a first cyclone element (1*a*) and then through a second cyclone element (1*b*). Each cyclone element (1*a*, 1*b*) comprises a cyclone axis, the cyclone axes being aligned in particular coaxially. Each cyclone element (1*a*, 1*b*) comprises at least one opening (31*a*, 31*b*) at the periphery, which is connected to a preferably common air delivery system (12), in particular in such a way that vortexes in both cyclone elements (1*a*, 1*b*) have the same direction of rotation. The (Continued)

Figure 1:
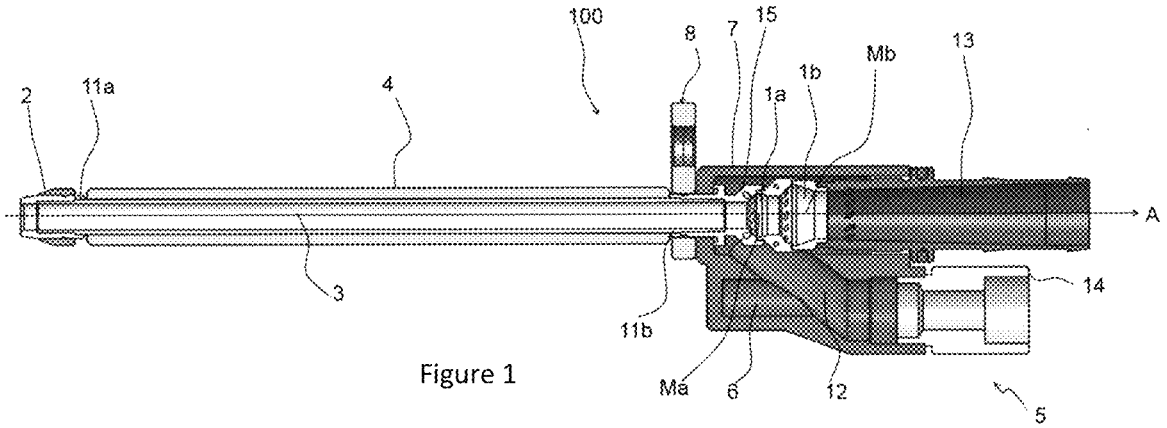

suction device (100) comprises in particular a Laval nozzle (13).

15 Claims, 2 Drawing Sheets

(58) Field of Classification Search
USPC ..... 226/97.4
See application file for complete search history.

(56) References Cited

U.S. PATENT DOCUMENTS 3,678,579 A * 7/1972 Slavik ..... B65H 51/16 83/100
3,690,530 A * 9/1972 Porter ..... B65H 54/88 226/97.4
3,886,972 A * 6/1975 Scott ..... F15D 1/06 137/13
3,970,231 A * 7/1976 Strutz ..... B65H 51/16 28/255
3,986,325 A * 10/1976 Ritter ..... B65H 54/88 57/305
3,999,579 A * 12/1976 Ohkouchi ..... D03D 47/32 226/97.4
4,114,790 A * 9/1978 Sighieri ..... B65H 54/88 226/97.4
4,119,253 A * 10/1978 Benson ..... D02G 1/162 57/208
4,181,247 A * 1/1980 McFall ..... B65H 51/16 28/255
4,226,092 A * 10/1980 Luthi ..... D02J 13/00 134/122 R
4,298,153 A * 11/1981 Stables ..... D01D 13/02 226/97.4
4,372,712 A * 2/1983 Powell ..... B01F 35/711 417/171
4,373,228 A 2/1983 Dyson
4,422,565 A * 12/1983 Reba ..... B26D 7/1863 226/7
4,470,529 A * 9/1984 Wetter ..... B65H 51/16 226/97.4
4,503,662 A 3/1985 Horiuchi et al.
4,667,864 A * 5/1987 Kiteck ..... B65H 54/88 57/22
4,684,296 A * 8/1987 Horii ..... B65G 53/42 451/99
4,694,998 A * 9/1987 McKinney ..... B65H 54/88 29/DIG. 84
4,784,344 A * 11/1988 Lenk ..... B65H 54/86 226/97.4
4,813,460 A * 3/1989 Van Bogaert ..... D03D 47/34 226/97.4
4,817,880 A * 4/1989 Lenk ..... B65H 51/22 226/97.4
4,858,809 A * 8/1989 Paulini ..... B65H 51/16 226/7
4,890,800 A * 1/1990 Lenk ..... B65H 54/86 226/97.4
5,060,351 A * 10/1991 Street ..... D02J 1/18 28/282
5,086,679 A * 2/1992 Fletcher ..... B65H 54/88 83/402
5,123,608 A * 6/1992 LeCompte ..... B65H 49/02 226/97.4
5,140,729 A * 8/1992 Simmen ..... D02G 1/161 28/271
5,191,680 A * 3/1993 Kaneko ..... D04H 3/16 226/97.4
5,241,730 A * 9/1993 Simmen ..... D02G 1/161 28/273
5,326,009 A * 7/1994 Kobayashi ..... D04H 3/03 226/97.4
5,374,141 A * 12/1994 Sun ..... B29C 70/305 406/96
5,619,780 A * 4/1997 Potter ..... D02G 1/167 28/258
5,746,072 A * 5/1998 Bohnke ..... B65H 20/14 34/640
5,857,606 A 1/1999 Tseng
6,182,879 B1 * 2/2001 Konig ..... B65H 54/88 226/97.4
7,101,504 B2 * 9/2006 Suzuki ..... D02J 13/00 226/97.4
7,311,474 B1 * 12/2007 Ogasahara ..... B65G 53/14 406/146
7,500,296 B2 * 3/2009 Bertsch ..... D02G 1/161 28/271
7,752,723 B2 * 7/2010 Bertsch ..... D02J 1/08 28/271
10,829,338 B2 * 11/2020 Bahlmann ..... D01H 4/44
11,608,234 B2 * 3/2023 Pino, Jr. ..... F16L 55/00
2004/0042857 A1 * 3/2004 DeHart ..... B65G 53/14 406/194
2005/0006424 A1 * 1/2005 Frankeberger ..... B65G 51/02 226/7
2005/0011061 A1 * 1/2005 Buchmuller ..... D02J 1/08 28/252
2011/0023273 A1 * 2/2011 Bauer ..... D01H 4/02 57/305

FOREIGN PATENT DOCUMENTS

DE 102013018012 A1 * 6/2014 ..... B65H 54/88
EP 0128121 A1 12/1984
EP 0244911 B1 * 5/1987
EP 0244911 A2 11/1987
EP 273292 A * 7/1988 ..... B65H 51/16
EP 0787674 A2 * 12/1996
JP S5424559 2/1979
JP 60161864 A * 8/1985 ..... B65H 54/88
JP S638174 1/1988
JP 2000335821 A * 12/2000 ..... B65H 54/88
KR 20120006481 9/2012
KR 20120006481 U * 9/2012
WO WO-2018108964 A1 * 6/2018 ..... B65H 54/88
WO WO-2021043731 A1 * 3/2021 ..... B65H 51/16

OTHER PUBLICATIONS

International Search Report International Application No. PCT/EP2020/061419 dated May 29, 2020, 3 pages.

* cited by examiner

SUCTION DEVICE FOR A TEXTILE MACHINE, TEXTILE MACHINE WITH A SUCTION DEVICE, USE OF TWO CYCLONE ELEMENTS, AND METHOD FOR SUCTIONING YARNS

The invention relates to a suction device for a textile machine, a textile machine with a suction device, the use of two cyclone elements and a method for sucking in yarns.

Suction devices for yarns are used for picking up and threading yarns into textile machines during operation. During running operation, the yarns are transported through the textile machine at high speed, making it difficult to thread yarns. Suction devices require suction pipes of a certain length to be able to reach the yarns. In order for the suction devices to be able to thread in yarns reliably, the known suction devices must generate high pressure forces. This is the only way to ensure that a sufficiently high yarn tension can be maintained to allow the yarn to be transported. Usually a cyclone element is used to increase the suction capacity of the suction device.

Cyclone elements connected in series are known from U.S. Pat. No. 4,503,662. However, these are not designed to suck in yarns, as they have different directions of rotation.

It is the task of the invention to remedy these and other disadvantages of the prior art and, in particular, to provide a suction device for a textile machine, a textile machine with a suction device, the use of two cyclone elements and a method for sucking in yarns, which can reliably suck in and transport yarns and at the same time have a high efficiency.

According to the invention, these tasks are solved by a suction device, for a textile machine, a textile machine with a suction device, the use of two cyclone elements and a method for sucking in yarns according to the independent claims.

The problem is solved in particular by a suction device for a textile machine. The suction device comprises a mouthpiece for introducing at least one yarn, a suction pipe for guiding the yarn and a suction element for generating a suction pressure. The suction element comprises at least two cyclone elements for generating a vortex flow of compressed air. The cyclone elements are arranged one behind the other in the suction direction, so that a yarn can be guided first through a first cyclone element and then through a second cyclone element. Each cyclone element comprises a cyclone axis, wherein the cyclone axes are aligned in particular coaxially. Each cyclone element comprises at least one opening on the periphery, which is connected to an air delivery system that is preferably common to both cyclone elements, in particular in such a way that vortexes in both cyclone elements have the same direction of rotation. The suction device comprises in particular a Laval nozzle.

In order to generate a sufficiently large yarn tension, the suction power must be correspondingly large. Due to the mentioned arrangement of cyclone elements, a high efficiency is possible, since the same yarn tension can be achieved with lower pressure than in an arrangement with one cyclone element. The cyclone elements are cone-shaped sections in a suction channel of the suction device, through which a vortex of fluid flow is created so that a negative pressure is created in the centre of the vortex. This negative pressure leads to an intake flow. The cyclone elements are thus suction elements. With this arrangement, a higher yarn tension can also be achieved at the same pressure as with an arrangement of one cyclone element. The pressure is between 4-16 bar. The cyclone elements can be of the same or different size. The at least one circumferential opening of the first cyclone element may be larger than the at least one circumferential opening of the second cyclone element. In particular, each cyclone element and the Laval nozzle comprises 3-25 circumferential openings. The cross-sectional diameter of the at least one circumferential opening of the cyclone elements and the Laval nozzle is substantially between 0.5 mm-3 mm. The circumferential aperture or apertures may be round, oval, elliptical, triangular or square or have any other suitable geometry. Another diffuser may be used instead of a Laval nozzle.

The suction element may comprise at least one connection to a compressed air line. The suction element may comprise at least one motor.

The suction direction corresponds to the direction in which the yarn is to be transported.

The suction pipe may comprise impact absorbing materials on its outside to prevent damage to the textile machine.

The mouthpiece can be detachably attached and/or fixable to the suction pipe. This allows the mouthpiece to be replaced if damaged or to be used for a specific application.

In particular, the size and weight of the suction device is such that a user can easily lift and use it. Preferably, the suction device includes a handle or holding portion for holding the suction device by a user. The suction device may also be designed to be an integral part of a textile machine.

The suction device may include fluid lines for connection to a fluid supply. The fluid lines may include cross-sectional diameter constrictions and/or other geometric modifications and/or surface coatings or structures to accelerate the fluid or reduce frictional losses. The suction device may comprise pumps, compressors or other fluid devices. The cyclone elements may comprise fluid directing elements such as grooves or protrusions.

All kinds of threads, yarns, cables or similar materials can be sucked through such a suction device. These can be made of artificial fibres (plastics such as PE, PP, etc.), natural fibres (cotton, wool, raffia, etc.) or mixed fibres. These materials may include monofilaments or multifilaments. The term "yarn" is used here to refer to all these types of materials that are processed in a textile machine.

Textile machines are generally understood to mean machines for the industrial production and processing of textiles, for example spinning machines, weaving machines, knitting machines and sewing machines.

Preferably, the second cyclone element comprises a larger vortex volume than the first cyclone element, in particular the second cyclone element comprises at least 120%, in particular at least 200%, preferably 150%, of the vortex volume of the first cyclone element.

This makes it easy to increase the suction force without using more compressed air. The vortex volume denotes the volume consisting of the averaged diameter of the vortex flow and the length in suction direction within a cyclone element.

Preferably, the suction device comprises a first suction diameter before the first cyclone element, a second suction diameter before the second cyclone element and a third suction diameter after the second cyclone element. The first suction diameter is smaller than the second and third suction diameters, in particular the second suction diameter is smaller than the third suction diameter.

This enables an optimal guidance of the air flow.

Preferably, the first cyclone element comprises a first maximum cyclone diameter transverse to the cyclone axis. The first maximum cyclone diameter is larger than the second suction diameter.

Preferably, the second cyclone element comprises a second maximum cyclone diameter transverse to the cyclone axis, the second maximum cyclone diameter being larger than the third suction diameter.

This allows for a larger swirl diameter in the second cyclone element. Since the pressure inside larger vortexes is smaller, the suction force is thus increased.

In another aspect of the invention, the problem is solved by a suction device for a textile machine, in particular by a suction device as previously described. The suction device comprises a mouthpiece for introducing at least one yarn, a suction pipe for guiding the yarn and a suction element for generating a suction pressure. The mouthpiece comprises at least one opening on the inside at the periphery. An air stream can be introduced into the mouthpiece through this opening, the opening being oriented in the suction direction so that the air stream introduced through this opening flows in the suction direction.

This makes it possible to easily create a suction pressure at the inlet of the suction device. Typically, the negative pressure is created at the end of the suction pipe opposite the mouthpiece. Since the suction pipe has a certain length, the vacuum must be correspondingly high in order to be able to apply sufficient suction force to the yarn. If, on the other hand, a stream of air is already introduced into the mouthpiece and a vacuum is thus generated, the yarn can be drawn into the suction pipe even with a low suction force. If the suction element described above is also used in this suction device, the amount of compressed air required can be further reduced.

Preferably, the suction pipe comprises a first tube channel for transporting yarns along the pipe axis and a second tube channel for transporting an air flow.

In this way, the air flow from a suction element at one end of the suction pipe can be easily introduced into the suction pipe and/or the mouthpiece to allow turbulence in the suction pipe and/or the mouthpiece.

Preferably, the air delivery system is designed such that the the air delivery system serves as an air supply to both the cyclone elements and the mouthpiece, in particular via the second tube channel.

If the intake elements (i.e. here the mouthpiece) and the suction elements (i.e. the cyclone elements) have the same air supply, a simple, compact design of the suction device is possible: an air flow only has to be generated at one point.

Preferably, the air supply from the air delivery system to at least one, preferably both, cyclone elements can be closed and/or, independently thereof, the air supply to the mouthpiece can be closed, in particular by a switch-over valve for switching an air flow between the second tube channel and at least one cyclone element.

Thus, depending on the desired function, a yarn can be sucked in and/or a yarn can be transported along the suction direction. The suction element for generating the suction pressure therefore has to provide a less high power.

Preferably, the suction device comprises an actuating element for closing and/or opening the air supply to at least one, preferably both, cyclone elements and/or to the mouthpiece by a user.

This enables easy handling of the suction device by a user. Alternatively, it is possible to arrange sensors at the mouthpiece and/or in the suction pipe and/or other elements of the suction direction, which monitor the suction process, and a control device, which enables an automated threading of the yarns.

The problem is further solved by a textile machine with a suction device as described above.

A textile machine can be designed to automatically detect a yarn beginning and to operate the suction device. The suction device may be movably mounted or attachable to the textile machine.

The problem is further solved by the use of two cyclone elements for the suction of yarns in a textile machine.

By using two cyclone elements, in particular two cyclone elements of different sizes, a greater yarn tension can be achieved with the same pressure of the air flow.

Further, the problem is solved by a method for sucking yarns in a textile machine with a suction device, in particular as previously described. The method comprises the steps:

Aligning the mouthpiece with yarn ends

Sucking the yarn ends through the mouthpiece into the suction pipe

Passing a yarn through a first and a second cyclone element.

Preferably, the method comprises the steps of:

Operating an operating element to close the air supply to at least one cyclone element and opening the air supply to a mouthpiece Operating the operating element to close the air supply to the mouthpiece and simultaneously opening the air supply to at least one cyclone element.

Embodiments of preferred suction devices are explained by way of example with reference to the following figures. They show:

FIG. 1: Cross-section through a first embodiment of a suction device

Figure 2:
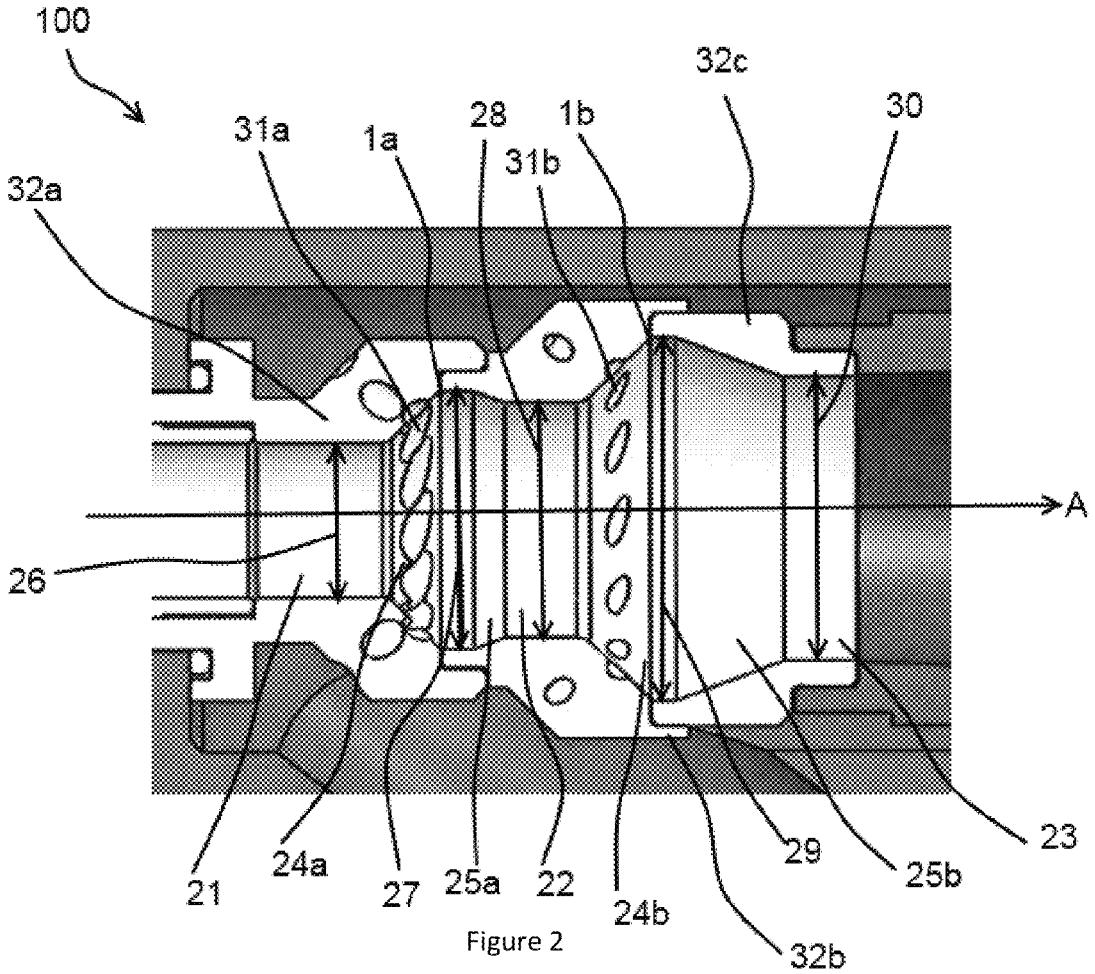

FIG. 2: Cyclone elements of the suction device shown in FIG. 1

Figure 3:
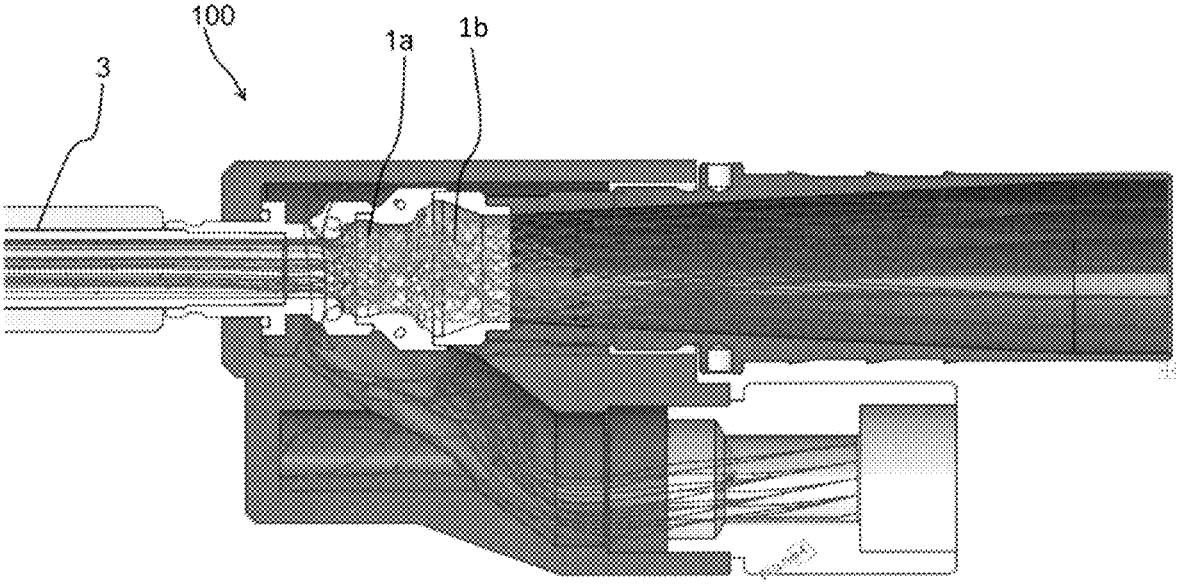

FIG. 3: Air flow through the cyclone elements of the suction device shown in FIG. 2

Figure 4:
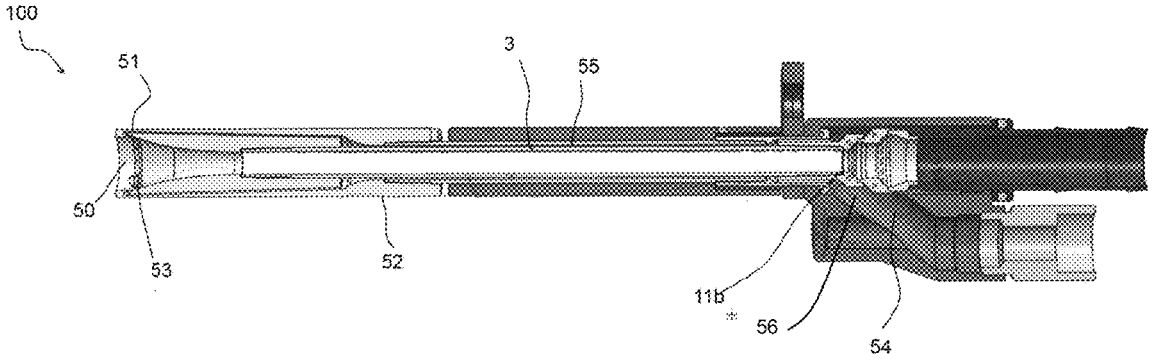

FIG. 4: Cross-section through a second embodiment of the suction device

FIG. 1 shows a cross-section through a suction device 100. The suction device 100 comprises a mouthpiece 2 at a first end of a suction pipe 3 in suction direction A, a suction pipe 3 and a suction element 5 with two cyclone elements 1*a* and 1*b* and a Laval nozzle 13, the walls of which open with a pitch between 2°-10°.

The suction pipe 3 comprises an outer shell 4 for protection against damage to a textile machine. At a first end 11*a* the mouthpiece 2 is attached to the suction pipe 3. At the opposite second end 11*b* a handle 8 is arranged. With this second end 11*b* the suction pipe 3 is connected to a housing 7 of the suction element 5.

The suction element 5 comprises this housing 7, the two cyclone elements 1*a*, 1*b* and a connection 14 to a compressed air line.

The housing 7 comprises an air chamber 6 and an air supply 12. The two cyclone elements 1*a* and 1*b* are arranged in the housing 7. The housing 7 comprises an interior 15 which surrounds the two cyclone elements 1*a* and 1*b* and supplies them with compressed air.

When using the suction device 100, the mouthpiece 2 is aligned with one end of the yarn. A stream of air is introduced into the cyclone elements 1*a* and 1*b* via the port 14 through the air supply 12. This creates a negative pressure, whereby a yarn is fed through the mouthpiece 2, the suction pipe 3, the first cyclone element 1*a*, the second cyclone element 1*b* into the Laval nozzle 13.

FIG. 2 shows in detail the cyclone elements 1*a* and 1*b* of the suction device 100 in cross-section.

Along the suction direction A, a pipe section 21 with a first suction diameter 26 of 4 mm is arranged first; in other embodiments (not shown here), the first suction diameter 26 can be up to 20 mm. This is followed by the first cyclone element 1*a*. The cross-section of the tube therefore opens in the first inlet section 31*a* of the first cyclone element 1*a* with a pitch of 60° to the first maximum cyclone diameter 27 of 6 mm, which is maintained for 1 mm. In other embodiments (not shown here), the first inlet section 31*a* may open with a pitch of up to 120° to the first maximum cyclone diameter 27 of up to 32 mm, which is maintained for up to 4 mm. Thereafter, the cyclone element 1*a* narrows in the first exit section 25*a* with a pitch of 30° to the second suction diameter 28 of 5 mm. In other embodiments (not shown here), the diameter in the first exit section 25*a* may be narrowed with a pitch of up to 60° to a second suction diameter 28 of up to 30 mm. The second suction diameter 28 is maintained in an intermediate section 22. The intermediate section 22 is 4 mm long. In other embodiments (not shown here), the intermediate section 22 may be up to 12 mm long. The second cyclone element 1*b* follows. Here, the tube opens with a 60° pitch in a second inlet section 24*b* to the second maximum cyclone diameter 29 of 8 mm. In other embodiments (not shown here), the second inlet section 24*b* may open with a pitch up to 120° to the second maximum cyclone diameter 29 of up to 48 mm, maintaining this diameter up to 4 mm. Thereafter, the second cyclone element 1*b* narrows with a pitch of 30° in an exit section 25*b* to the third suction diameter 30 of 6 mm in the transition section 23. In other embodiments (not shown here), the diameter in the second exit section 25*b* may narrow with a pitch of up to 60° to a third suction diameter 30 of up to 37 mm. The third suction diameter 30 is maintained for 4 mm.

Peripheral openings 31*a* and 31*b* are provided in the first and second inlet sections 24*a* and 24*b*, respectively, through which air flows are directed into the cyclone elements 1*a* and 1*b*.

The cyclone elements 1*a* and 1*b* are formed by three successive plug-on sections 32*a*, 32*b* and 32*c* in the suction direction. The first plug-on element 32*a* comprises the pipe section 21 and the inlet section 24*a*. The second push-on element 32*b* comprises the area with the first maximum cyclone diameter 27, the first outlet section 25*a*, the intermediate section 22 and the second inlet section 24*b*. The third push-out element 32*c* comprises the region with the second maximum cyclone diameter 29, the outlet section 25*b* and the transition section 23.

The first push-on element 32*a* is pushed onto the second push-on element 32*b* and the second push-on element 32*c* is pushed onto the third push-on element 32*c*.

FIG. 3 shows the air flow through the cyclone elements 1*a* and 1*b* of the suction device 100. The air flow through the suction pipe 3 is substantially parallel to the inner walls of the suction pipe 3. The vortex volume in the first cyclone element 1*a* comprises almost the entire volume of the cyclone element 1*a*. The vortex volume of the second cyclone element 1*b* is larger than that of the first. The vortex volume is the volume consisting of the average diameter of the vortex flow and the length in suction direction within a cyclone element.

FIG. 4 shows a cross-section of a further embodiment of the suction device 100. Only the differences from the first embodiment of the suction device 100 are explained here.

The suction device 100 comprises an attachment element 52 which is placed on the suction pipe 3. The suction pipe 3 of this embodiment is shorter than in the previous embodiment. This suction pipe 3 also comprises an air duct 55 which guides an air flow from the air supply 54 to the attachment element 52.

The mouthpiece 50 of this embodiment is part of the attachment element 52. The attachment element 52 further comprises an air channel 51 which is connected to the air channel 55 of the suction pipe 3. The air channel 51 guides the air flow from the suction pipe 3 to openings 53 at the periphery in the mouthpiece 50. This allows a suction flow to be generated already at the entrance to the suction device 100. In conventional suction devices 100, the suction is generated at the other end 11*b* of the suction pipe 3, which requires a greater suction force.

The embodiment of FIG. 4 can also be executed without a double cyclone.

FIG. 4 further shows an operating element formed by a switch-over valve 56 which is adapted for closing and opening the air supply 54 to the cyclone elements and closing and opening the air supply 54 to the mouthpiece by a user. While closing the air supply 54 to the mouthpiece, the air supply to the cyclone element may be simultaneously opened. Alternatively, the air supply 54 to the cyclone elements can be closed and/or the air supply 54 to the mouthpiece 50 can be closed independently thereof by means of the switch-over valve 56 for switching an air flow between the air channel 55 and the cyclone elements.

The invention claimed is:

1. A suction device for a textile machine, wherein the suction device comprises two cyclone elements for generating a vortex flow of compressed air arranged one behind the other in a suction direction, so that the yarn can be guided through a first cyclone element and then through a second cyclone element, wherein each cyclone element comprises a cyclone axis and the cyclone axes are aligned coaxially, a suction pipe for guiding the yarn and a suction element for generating a suction pressure, a mouthpiece for introducing at least one yarn, the mouthpiece comprising at least one opening on a circumference of the mouthpiece on an inner side of the mouthpiece, and an air delivery system constructed and arranged such that the air delivery system serves as an air supply to the mouthpiece and at least one of the cyclone elements, wherein air flow can be introduced into the mouthpiece through the at least one opening, wherein the at least one opening is aligned in the suction direction so that the air flow introduced through the at least one opening flows in the suction direction.

2. The suction device according to claim 1, wherein the suction pipe comprises a first tube channel for transporting yarns along a pipe axis of the suction pipe and a second tube channel for transporting an air flow.

3. The suction device according to claim 1, wherein the air supply from the air delivery system to the cyclone elements can be closed, and/or the air supply to the mouthpiece can be closed independently thereof.

4. The suction device according to claim 3, wherein the suction device comprises an operating element for closing and/or opening the air supply to at least one of the cyclone elements and/or to the mouthpiece by a user.

5. A textile machine comprising a suction device according to claim 1.

6. A method for sucking yarns in a textile machine with a suction device, according to claim 1, comprising the steps of:

aligning a mouthpiece with yarn ends;

sucking the yarn ends through the mouthpiece into a suction pipe; and passing a yarn through a first and a second cyclone element.

7. The method according to claim 6, wherein the method comprises the steps of operating an operating element to close the air supply to at least one cyclone element operating the operating element to close the air supply to the mouthpiece and simultaneously opening the air supply to at least one cyclone element.

8. The suction device according to claim 1, wherein the air delivery system is a common air delivery system for the cyclone elements.

9. The suction device according to claim 8, wherein the at least one opening at the periphery is connected to a common air supply in such a way that vortexes in both cyclone elements have the same direction of rotation.

10. The suction device according to claim 1, wherein the suction device comprises a Laval nozzle.

11. The suction device according to claim 1, wherein a vortex volume of a second cyclone element comprises at least 120% of a vortex volume of the first cyclone element.

12. The suction device according to claim 1, wherein the suction device comprises a first suction diameter upstream of the first cyclone element, a second suction diameter upstream of the second cyclone element and a third suction diameter downstream of the second cyclone element, the first suction diameter being smaller than the second and third suction diameters and the second suction diameter being smaller than the third suction diameter.

13. The suction device according to claim 1, wherein the air delivery system serves as an air supply to the mouthpiece via a second tube channel.

14. The suction device according to claim 3, wherein the air supply from the air delivery system to at least one of the cyclone elements can be closed, and/or the air supply to the mouthpiece can be closed independently thereof by means of a switch-over valve for switching an air flow between the second tube channel and at least one cyclone element.

15. The method according to claim 6, wherein the suction device is a suction device according to claim 1.

* * * * *